US009094753B2

(12) United States Patent
Kung

(10) Patent No.: US 9,094,753 B2
(45) Date of Patent: Jul. 28, 2015

(54) WIRELESS MICROPHONE STRUCTURE

(71) Applicant: Te-Wei Kung, Chia-Yi (TW)

(72) Inventor: Te-Wei Kung, Chia-Yi (TW)

( * ) Notice: Subject to any disclaimer, the term of this patent is extended or adjusted under 35 U.S.C. 154(b) by 337 days.

(21) Appl. No.: 13/632,208

(22) Filed: Oct. 1, 2012

(65) Prior Publication Data

US 2014/0093099 A1 Apr. 3, 2014

(51) Int. Cl.
*H04R 3/00* (2006.01)
*H04R 1/04* (2006.01)

(52) U.S. Cl.
CPC ..... *H04R 1/04* (2013.01); *H04R 2420/07* (2013.01)

(58) Field of Classification Search
CPC ..... H04R 3/00; H04R 3/005
USPC ..... 381/119, 109, 122, 80
See application file for complete search history.

(56) References Cited

U.S. PATENT DOCUMENTS 5,881,156 A * 3/1999 Treni et al. ..... 381/91
2013/0121504 A1 * 5/2013 Adams et al. ..... 381/92

* cited by examiner

*Primary Examiner* — Alexander Jamal
(74) *Attorney, Agent, or Firm* — Alan D. Kamrath; Kamrath IP Lawfirm, P.A.

(57) ABSTRACT

A wireless microphone structure contains a cartridge module, an audio output switch, a gain controller, an audio amplifier, and a sound mixer. After the cartridge module receives sounds, the sounds are outputted from the sound mixer via the gain controller and an audio amplifier. A power source supplies power via a regulator circuit. The sound mixer has an input port and an output port of a network cable, so that an input port and an output port of each of at least one wireless microphone are connected together via the network cable.

7 Claims, 6 Drawing Sheets

WIRELESS MICROPHONE STRUCTURE

BACKGROUND OF THE INVENTION

1. Field of the Invention

The present invention relates to a wireless microphone structure and, more particularly, to the wireless microphone structure which allows connecting audio frequencies of a plurality of microphones in a wireless manner to further output sounds from an amplifier.

2. Description of the Prior Art

A conventional wireless microphone is used to output audio signals and to transform the audio signals into sounds. Thereafter, the sounds are outputted from a speaker in a wireless manner. Thus, the conventional wireless microphone has to provide a main host (a signal receiving converter) therein, so that after the audio signals are received, an amplifier is driven to output the sounds from the speaker. However, a using number of the conventional wireless microphone is limited by the main host which processes the audio signals. Therefore, the conventional wireless microphone only has two wireless microphones for matching with the main host.

When more than two wireless microphones have to be provided in a meeting, such a conventional wireless microphone, which can only provide two wireless microphones, will not satisfy using requirements. Accordingly, the two wireless microphones are used in turn, thus causing using inconvenience. Alternately, an additional wired microphone is provided in the meeting, but its wire will stumble users.

The present invention has arisen to mitigate and/or obviate the afore-described disadvantages.

SUMMARY OF THE INVENTION

The primary object of the present invention is to provide a wireless microphone structure which is not necessary to provide a main host between at least one wireless microphone and the amplifier.

A further object of the present invention is to provide a wireless microphone structure capable of using a plurality of wireless microphones simultaneously to solve an insufficiency of conventional wireless microphones.

Another object of the present invention is to provide a wireless microphone structure in which a circuit line of the plurality of wireless microphones is in connection with an amplifier, so a connection method between the plurality of wireless microphones and the amplifier is variable based on using requirements.

A wireless microphone structure in accordance with a preferred embodiment of the present invention contains a cartridge module, an audio output switch, a gain controller, an audio amplifier, and a sound mixer. The sound mixer has an input port and an output port of a network cable.

In addition, the output port connects with a wireless transmitter module to output wireless audio signals (i.e., the audio output switch conducts sound received by the cartridge module via the gain controller and the audio amplifier, and, then, the sound is transmitted by an antenna via the wireless transmitter module). The wireless audio signals are acquired by an amplifier through a wireless receiver module and then are transformed into sounds. Thereafter, the sounds are inputted from a speaker, so it is not necessary to provide a main host between at least one wireless microphone and the amplifier.

In this embodiment, when a plurality of wireless microphones is used on a pair of an amplifier and a speaker, an input port and an output port of each wireless microphone are connected together, and an output port of a last wireless microphone inputs the wireless audio signals through the wireless transmitter module (the output port of the last wireless microphone couples with the amplifier by using the network cable to form a wired connection), so that after the wireless receiver module acquires the audio signals, the amplifier and the speaker output the sounds directly. Thereby, a using number of the microphones is increased without being limited by signal receiving and conversion, capacity of the main host.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
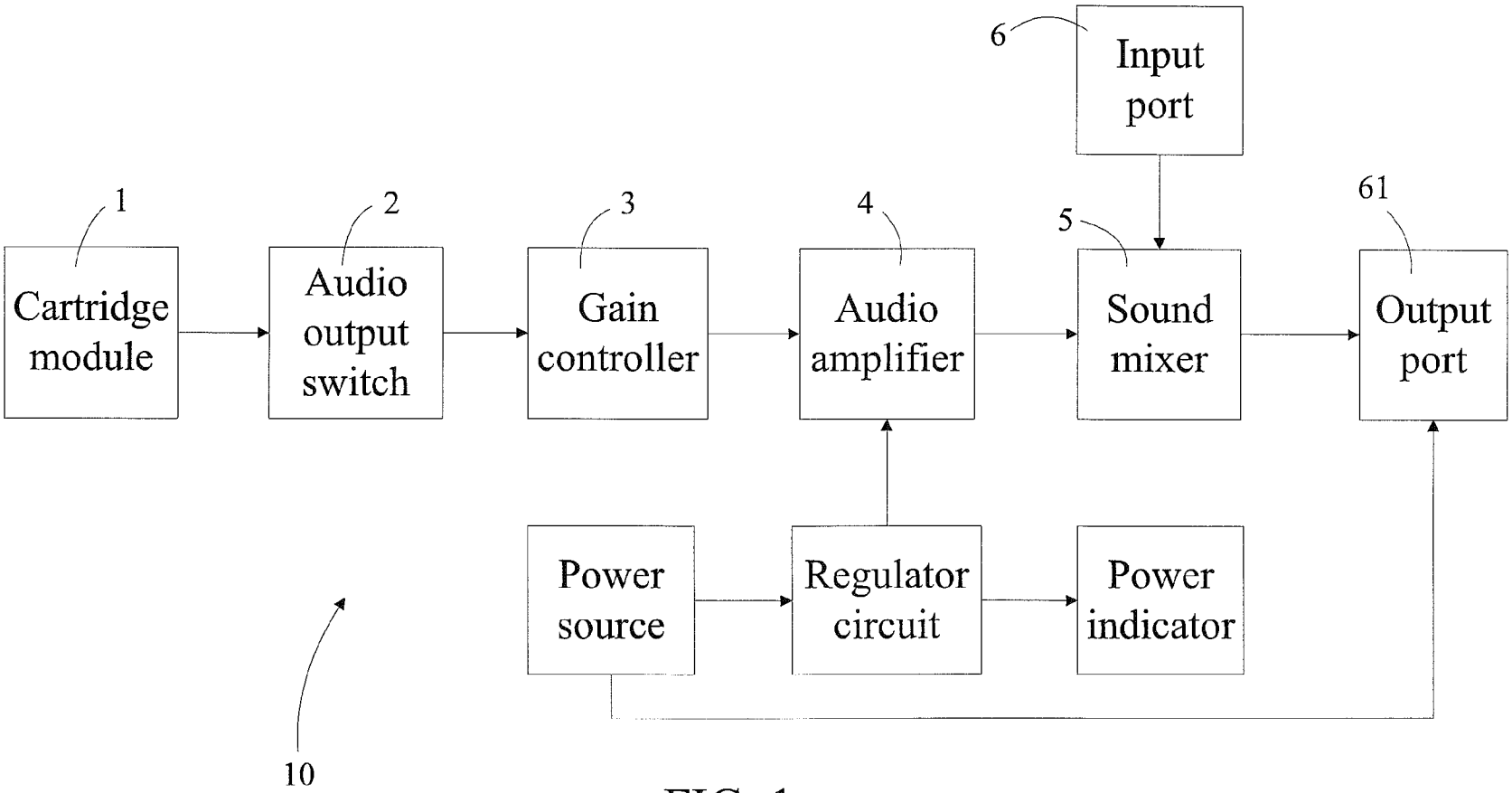
FIG. 1 is a block diagram of a wireless microphone structure according to a first embodiment of the present invention.

A wireless microphone structure according to a first embodiment of the present invention comprises: a cartridge module 1, an audio output switch 2, a gain controller 3, an audio amplifier 4, and a sound mixer 5 (as shown in FIG. 1). A power source supplies power via a regulator circuit (such as providing a power indicator to display a power supply), and the sound mixer 5 has an input port 6 and an output port 61 of a network cable.

Figure 2:
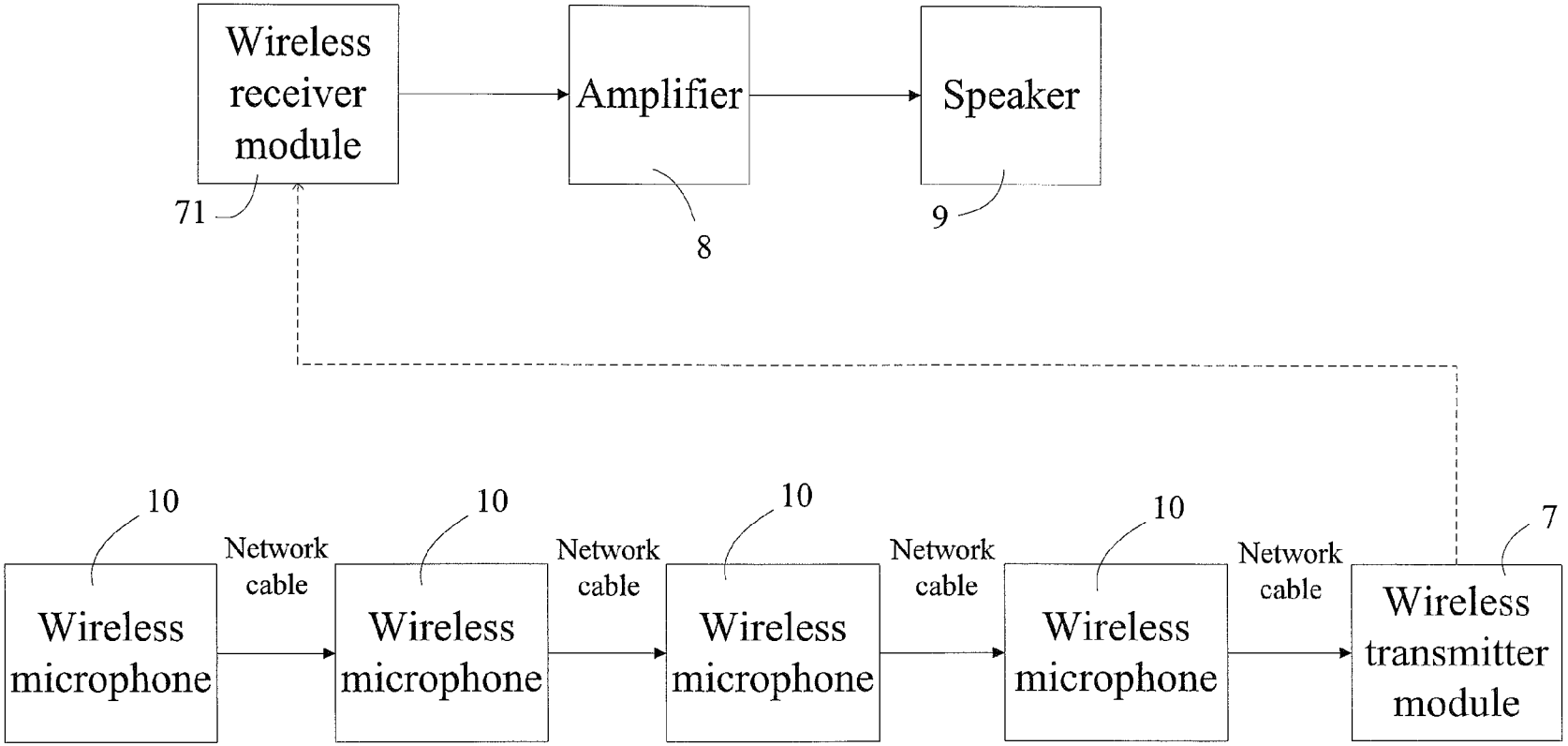
FIG. 2 is a block diagram showing the operation of the wireless microphone structure according to the first embodiment of the present invention.

In addition, the output port 61 connects with a wireless transmitter module 7 to output wireless audio signals (i.e., the audio output switch 2 conducts sound received by the cartridge module 1 via the gain controller 3 and the audio amplifier 4, and, then, the sound is transmitted by an antenna via the wireless transmitter module 7). The wireless audio signals are acquired by an amplifier 8 through a wireless receiver module 71 and, then, are transformed into sounds. Thereafter, the sounds are inputted from a speaker 9 (as illustrated in FIG. 2), so it is not necessary to provide a main host between at least one wireless microphone 10 and the amplifier 8.

Figure 3:
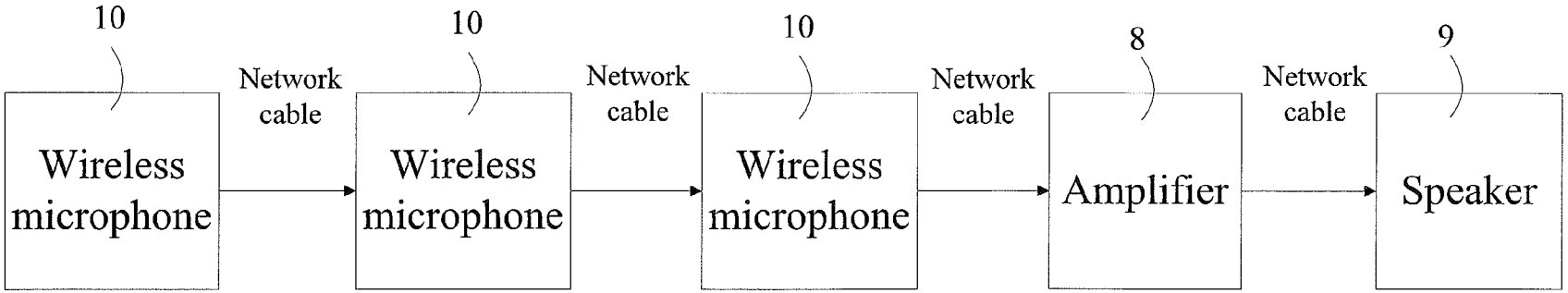
FIG. 3 is another block diagram showing the operation of the wireless microphone structure according to the first embodiment of the present invention.

In this embodiment, when a plurality of wireless microphones 10 is used on a set of an amplifier 8 and a speaker 9, an input port 6 and an output port 61 of each wireless microphone 10 are serially connected together. An output port 61 of a last wireless microphone 10 inputs the wireless audio signals through the wireless transmitter module 7 (the output port 61 of the last wireless microphone 10 couples with the amplifier 8 by using the network cable to form a wired connection as shown in FIG. 3), so that after the wireless receiver module 71 acquires the audio signals, the amplifier 8 and the speaker 9 output the sounds directly. Thereby, a using number of the plurality of microphones 10 is increased without being limited by signal receiving and conversion capacity of the main host.

Figure 4:
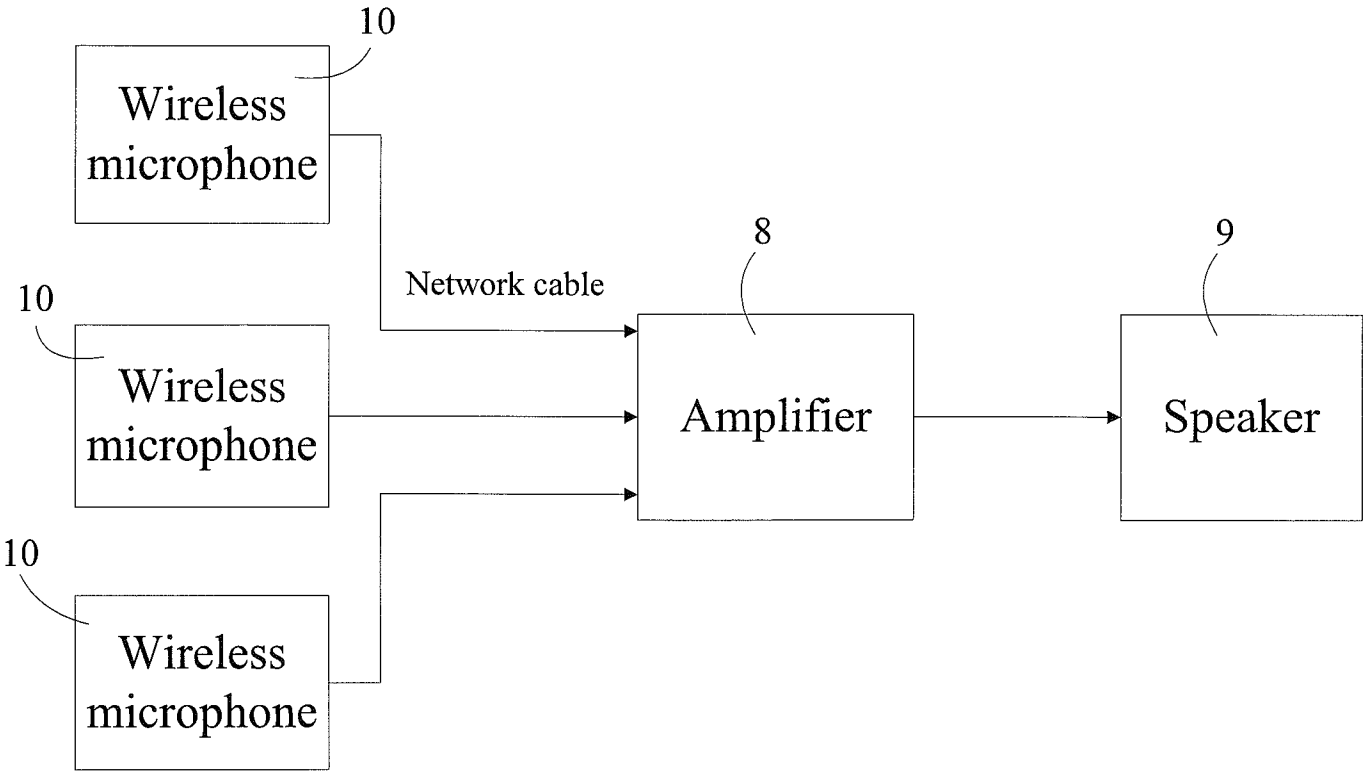
FIG. 4 is also another block diagram showing the operation of the wireless microphone structure according to the first embodiment of the present invention.

Since the plurality of microphones 10 has an independent audio signal output, the network cables of their output ports 61 parallelly connected with the amplifier 8 are based on using requirements (as shown in FIG. 4), thus using each microphone 10 independently.

Figure 5:
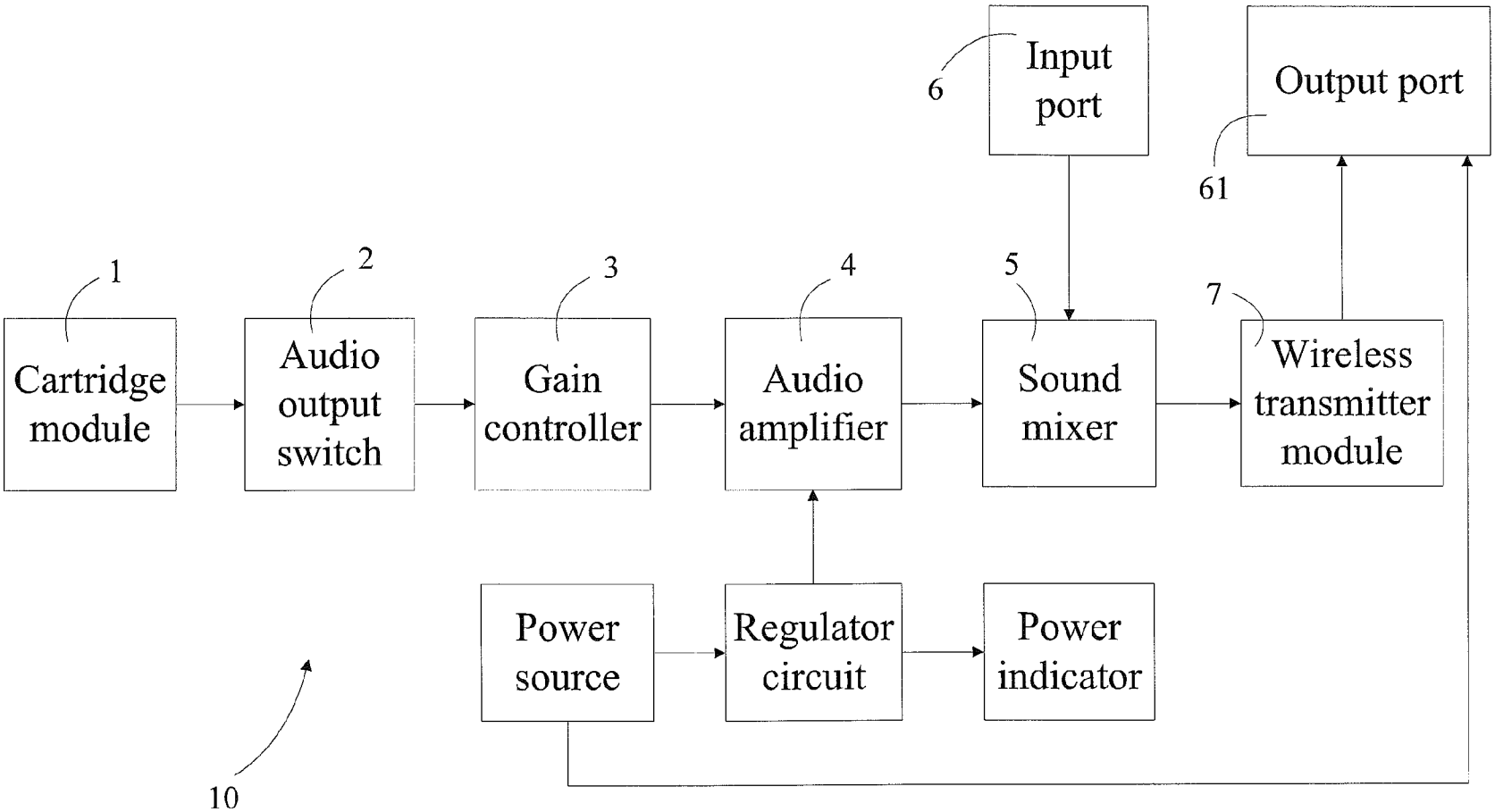
FIG. 5 is a block diagram of a wireless microphone structure according to a second embodiment of the present invention.

In addition, between the sound mixer 5 of each microphone 10 and the output port 61 of the network cable is capable of fixing the wireless transmitter module 7 (as shown in FIG. 5), thus using the wireless microphone structure easily and avoiding complicated circuit line.

Figure 6:
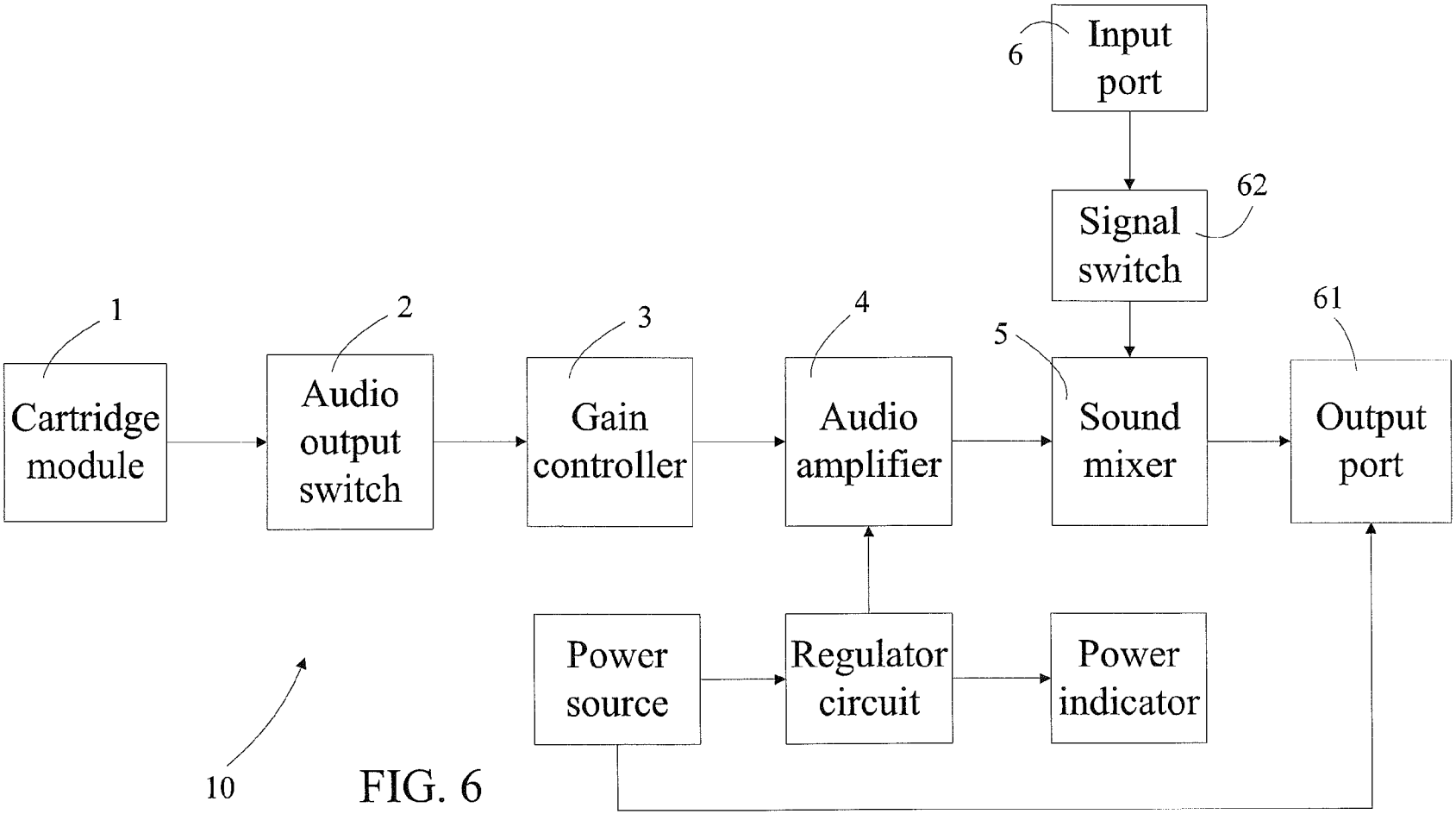
FIG. 6 is a block diagram of a wireless microphone structure according to a third embodiment of the present invention.

Besides, the output port 61 of the each wireless microphone 10 allows having a signal switch 62 to disconnect or connect signals of the network cable (as shown in FIG. 6). After the plurality of wireless microphones 10 is serially connected together, the wireless audio signals from the plurality of wireless microphone 10 are outputted toward the amplifier 8 by switching on the signal switch 62. The last wireless microphone 10 is used by a host in a meeting, so that the signal switch 62 stops the wireless audio signals of the other wireless microphones 10, and the host speaks smoothly without being interfered by the other wireless microphones 10.

While various embodiments in accordance with the present invention have been shown and described, it is clear to those skilled in the art that further embodiments may be made without departing from the scope of the present invention.

What is claimed is:

1. A wireless microphone structure as comprising:

at least one wireless microphone comprising a cartridge module, an audio output switch, a gain controller, an audio amplifier, a sound mixer, with the cartridge module receiving sounds outputted from the sound mixer via the gain controller and the audio amplifier, and a power source supplying power via a regulator circuit, wherein the sound mixer has an input port and an output port;

a speaker amplifier; and a speaker electrically connected to the speaker amplifier, wherein the output port of the sound mixer of each of the at least one wireless microphone is connected with the speaker amplifier to transmit audio signals.

2. The wireless microphone structure as claimed in claim 1, wherein the output port of the sound mixer of each of the at least one wireless microphone connects with a wireless transmitter module to output wireless audio signals, wherein the wireless audio signals are acquired by the speaker amplifier through a wireless receiver module.

3. A wireless microphone structure comprising:

at least one wireless microphone comprising a cartridge module, an audio output switch, a gain controller, an audio amplifier, a sound mixer, with the cartridge module receiving sounds outputted from the sound mixer via the gain controller and the audio amplifier, and a power source supplying power via a regulator circuit, wherein: the sound mixer has an input port and an output port, wherein the sound mixer of the at least one wireless microphone is in connection with the output port via a wireless transmitter module to transmit wireless audio signals directly.

4. A wireless microphone structure comprising:

at least one wireless microphone comprising a cartridge module, an audio output switch, a gain controller, an audio amplifier, a sound mixer, with the cartridge module receiving sounds outputted from the sound mixer via the gain controller and the audio amplifier, and a power source supplying power via a regulator circuit, wherein: the sound mixer has an input port and an output port, wherein the input port of the sound mixer of the at least one wireless microphone connects with the sound mixer via a signal switch so that signals are disconnected or connected.

5. The wireless microphone structure as claimed in claim 1, wherein the at least one wireless microphone comprises a plurality of wireless microphones connected serially to the speaker amplifier.

6. The wireless microphone structure as claimed in claim 2, wherein the at least one wireless microphone comprises a plurality of wireless microphones connected serially to the speaker amplifier.

7. The wireless microphone structure as claimed in claim 1, wherein the at least one wireless microphone comprises a plurality of wireless microphones connected in parallel to the speaker amplifier.

* * * * *